United States Patent [19]

Buddenhagen

[11] 4,200,065

[45] Apr. 29, 1980

[54] METHOD FOR PREVENTING UNDESIRABLE HEAT LOSSES IN A COOLING SYSTEM FOR LIQUID-COOLED VEHICULAR INTERNAL-COMBUSTION ENGINES

[75] Inventor: Uwe Buddenhagen, Münich, Fed. Rep. of Germany

[73] Assignee: Maschinenfabrik Augsburg-Nurnberg Aktiengesellschaft, Munich, Fed. Rep. of Germany

[21] Appl. No.: 898,329

[22] Filed: Apr. 20, 1978

[30] Foreign Application Priority Data

May 11, 1977 [DE] Fed. Rep. of Germany ..... 2721064

[51] Int. Cl.[2] ..... F01P 3/22

[52] U.S. Cl. ..... 123/41.54; 123/41.51; 165/35

[58] Field of Search ..... 123/41.08, 41.1, 41.02, 123/41.54, 41.29, 41.51; 165/35

[56] References Cited

U.S. PATENT DOCUMENTS

| | | | |
|---|---|---|---|
| 2,032,670 | 3/1936 | Simmen | 123/41.51 |
| 2,362,015 | 11/1944 | Lunquist | 123/41.51 |
| 2,408,374 | 10/1946 | Clapsadle et al. | 123/41.51 |
| 3,726,262 | 4/1973 | Moon | 123/41.54 |
| 3,805,748 | 4/1974 | Garcea et al. | 123/41.1 |
| 3,877,443 | 4/1975 | Henning et al. | 123/41.08 |
| 3,981,279 | 9/1976 | Bubniak et al. | 123/41.02 |
| 4,064,848 | 12/1977 | Pabst et al. | 123/41.54 |

FOREIGN PATENT DOCUMENTS

| | | | |
|---|---|---|---|
| 595852 | 3/1931 | Fed. Rep. of Germany | 123/41.1 |

*Primary Examiner*—Charles J. Myhre
*Assistant Examiner*—Jeffrey L. Yates
*Attorney, Agent, or Firm*—Scully, Scott, Murphy & Presser

[57] ABSTRACT

A method for preventing undesirable heat losses in a cooling system for liquid-cooled vehicular internal-combustion engines by affecting the flow at the connections of the lines to and from the header tank of the cooling system by measures commonly practiced in flow engineering such that the pressure will be the same at the inlet and the outlet of the header tank, so that with the thermostat closed no coolant is allowed to flow through the header tank and on through the radiator. With a cooling system having an engine vent line which connects to the header tank this method produces, by affecting the flow in the engine vent area and with the engine running and the thermostat closed, a pressure at the connecting point of the vent line for engine venting which is equal to that prevailing at the entry of the vent line to the header tank.

8 Claims, 1 Drawing Figure

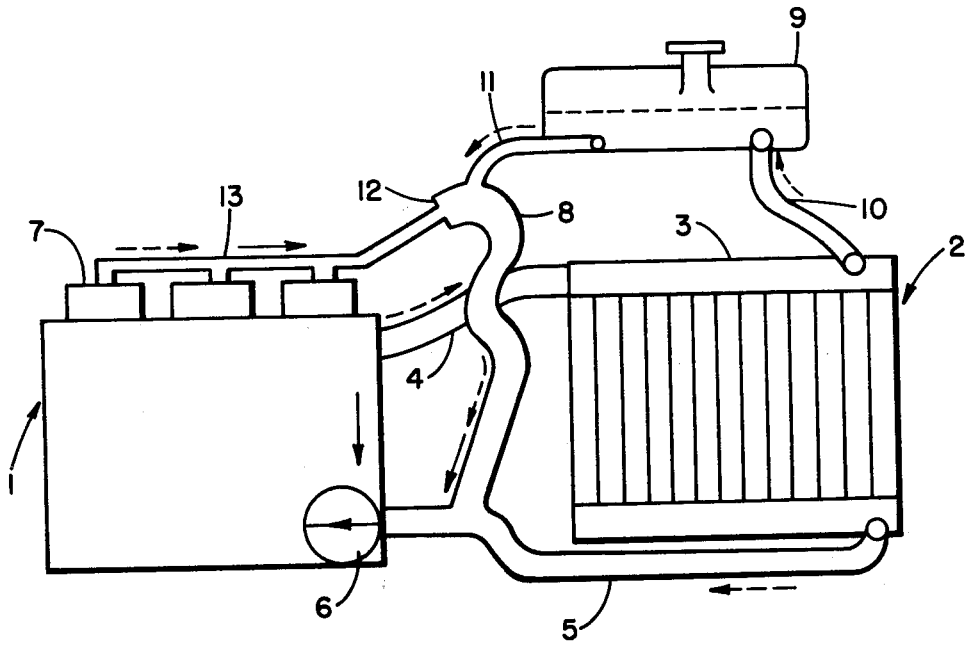
9
11
12
13
8
10
7
3
2
4
1
6
5

METHOD FOR PREVENTING UNDESIRABLE HEAT LOSSES IN A COOLING SYSTEM FOR LIQUID-COOLED VEHICULAR INTERNAL-COMBUSTION ENGINES

This invention relates to a method for preventing undesirable heat losses in a cooling system for liquid-cooled vehicular internal-combustion engines having a radiator, thermostat, header tank, circulation pump and suitable ducting system with lines to connect the units to each other and to the engine.

Such cooling systems are normally characterized in that, when the thermostat is closed, there remains flow via the header tank and the radiator, which may cause undesirable cooling.

At present it is generally being attempted to minimize this undesirable flow by installing restrictors or by using manually operated cocks.

Both solutions are embarrassed by disadvantages.

In a broad aspect the present invention eliminates the undesirable heat losses when the thermostat is closed without involving the disadvantages associated with the installation of cocks and restrictors.

It is a particular object of the present invention to provide a method by which the flow through the header tank and on through the radiator is completely or nearly completely prevented when the thermostat is closed.

Said method consists of producing, when the thermostat is closed, the same pressure at the inlet and the outlet (respectively at the inlets and outlets) of the header tank by affecting the flow conditions at the connections of the lines leading to and from the header tank by measures commonly practiced in flow engineering, such as flow deflections, increase or decrease of the flow velocity and, thus, decrease or increase of the respective static pressure, said equalization of pressure preventing the continued flow of coolant through the header tank and on through the radiator when the thermostat is closed. This concurrently prevents the associated heat loss.

This invention relates to a cooling system suitably designed for the implementation of the method in accordance with the present invention. This cooling system is characterized in that the flow in the engine venting area is affected, with the engine running and the thermostat closed, to produce a pressure at the connectng point of the vent line for engine venting which is equal to that prevailing at the entry of the vent line to the header tank.

Further aspects of the present invention will become apparent from the subclaims.

A cooling system to implement the method of the present invention is schematically illustrated on the accompanying drawing and is described in more detail below.

A cooling system for a liquid-cooled internal-combustion engine 1 has a radiator 2 which at its upper end has an upper water chamber 3. A first connecting line 4 is connected, by one of its ends, to the upper water chamber 3 of the radiator 2 and is connected at its other end to an outlet pipe of the engine 1. A thermostat, which is not shown on the drawing, is arranged in the engine 1 in the area of connection of the first connecting line 4. A second connecting line 5 is connected, by one of its ends, to the lower water chamber of the radiator 2 and leads to the inlet pipe of a circulation pump 6 which is connected to the coolant circulation system in the engine 1.

A header tank 9 serving to compensate the cooling liquid and to accommodate the gas bubbles separated from the cooling liquid is arranged above the upper water chamber 3 of the radiator 2.

The radiator 2 is connected to the header tank via the line 10. The cylinder heads 7 of the engine 1 are connected to the suction-side connection of the circulation pump 6 via vent pipes 13 and a coolant line 8. In this arrangement a sudden change in diameter was provided at point 12 and downstream of it, at the highest point of the coolant line 8, the branch of a vent line 11 to the header tank 9.

In this arrangement the diameters and lengths of the two sections of the coolant line 8 are selected to suit the pressure conditions at the vent pipes and the connecting point upstream of the pump 6 such that with the engine running and the thermostat closed the pressure at the branch in the vent line 11 will be the same as that prevailing at the entry of the connecting line 10 to the upper water chamber 3 of the radiator. Equalization of pressure here serves to prevent flow through the header tank 9 when the thermostat is closed. Also, the diameters of the various line sections between the vent pipe 13 of the engine 1 and the header tank 9 are selected such that the separation of vapor is not impaired when the engine is shut down. For the same reason of adequate gas separation when the engine is shut down, said line sections are given a continuous upgrade.

The line 8 is insulated between the vent pipes and the connecting point upstream of pump 6 to prevent heat losses at low ambient temperatures.

A secondary circuit serving to heat the vehicle cabin is connected to the coolant circuit, said secondary circuit not being shown.

The system arranged in accordance with the present invention operates as follows:

When the system is being filled with coolant the engine 1 is vented via the cylinder heads 7 and the vent pipes 13. When the system has been filled with cooling liquid and the engine is running and the thermostat open, cooling liquid from the second connecting line 5 is delivered to the engine coolant circuit by the circulation pump 6. After absorption of the volume of heat transferred from the engine to be cooled to the cooling liquid the cooling liquid is ducted for cooling to the radiator 2 via the first connecting line 4. In the process the cooling liquid passes through the thermostat, said thermostat controlling the flow rate of the cooling liquid as a function of the temperature of the cooling liquid. A portion of the cooling liquid reaches the header tank 9 through the connecting line 10.

A further portion of the cooling liquid is used in the secondary circuit for heating the vehicle cabin.

When the thermostat is closed the pressure at the point of the connecting line 8 where the line 11 branches off is the same as that prevailing at the entry of the line 10 to the upper water chamber 3 of the radiator 2, thus preventing flow through the header tank 9 and giving a maximum volume of heat for heating the vehicle cabin.

On the drawing the direction of flow of the cooling liquid when the engine is running and the thermostat open is illustrated by arrowheads drawn in broken line, while the arrowheads drawn in solid line illustrate the direction of flow of the cooling liquid when the engine is running and the thermostat closed.

What is claimed is:

1. In a cooling system for a liquid-cooled internal combustion engine having a cooling medium circuit in which the engine is connected to a radiator through a cooling medium inlet conduit having a thermostat arranged therein, a pump pumps cooling medium through a cooling medium return conduit, a header tank is connected with the radiator and is also connected through a vent conduit to a vent connection on the engine, the improvement comprising:

(a) said vent connection (13) being connected through a further cooling medium conduit (8) to a portion of the cooling medium circuit having a lower pressure than that at said vent connection (13) thereby forming a pressure gradient along said cooling medium conduit (8), with one location therein having a pressure (p) equal to the pressure at the inlet of the vent conduit (11) to the header tank (9,3); and (b) said vent conduit (11) being connected to the cooling medium conduit (8) at said location having the pressure (p), whereby circulation of coolant through said vent conduit (11) is prevented by said equalization of pressures.

2. Cooling system in accordance with claim 1, characterized in that the low-pressure point of the coolant circuit is located upstream of the entry to the circulation pump (6).

3. Cooling system of claim 1, characterized in that the pressure (P) occurs, with the engine (1) running and the thermostat closed, at the highest point of the coolant line (8).

4. Cooling system of claim 3, characterized in that to produce the pressure (P) a sudden change in diameter (12) in the coolant line (8) is provided at the highest point of the coolant line (8).

5. Cooling system of claim 3, characterized in that to produce the pressure (P) a restrictor is provided in the coolant line (8) at the highest point of the coolant line (8).

6. Cooling system of claim 4, characterized in that the coolant line (8) is smaller in diameter upstream of the sudden change in diameter (12) than it is downstream of the sudden change in diameter (12), and in that the connecting point of the vent line (11) is located downstream of the sudden change in diameter (12).

7. Cooling system of one of the claims 1 or 2 or 3 or 4 or 5 or 6, characterized in that the coolant line (8) is insulated over its length between the vent pipe (13) of the engine (1) and the connecting point of the coolant line (8) upstream of the entry to the pump (6) to prevent heat losses.

8. Cooling system of one of the preceding claims 1 or 2 or 3 or 4 or 5 or 6, characterized in that the upper water chamber (3) of the radiator (2) is provided to serve as a header tank (9, 3).

* * * * *